US009463505B2

(12) United States Patent
Murselaj

(10) Patent No.: US 9,463,505 B2
(45) Date of Patent: Oct. 11, 2016

(54) PISTON FOR METAL DIE CASTING

(71) Applicant: Gani Murselaj, Gurmels (CH)

(72) Inventor: Gani Murselaj, Gurmels (CH)

( * ) Notice: Subject to any disclaimer, the term of this patent is extended or adjusted under 35 U.S.C. 154(b) by 0 days.

(21) Appl. No.: 14/781,998

(22) PCT Filed: Apr. 3, 2014

(86) PCT No.: PCT/CH2014/000043

§ 371 (c)(1),
(2) Date: Oct. 2, 2015

(87) PCT Pub. No.: WO2014/161101

PCT Pub. Date: Oct. 9, 2014

(65) Prior Publication Data

US 2016/0038998 A1 Feb. 11, 2016

(30) Foreign Application Priority Data

Apr. 4, 2013 (CH) ..... 0719/13

(51) Int. Cl.
*B22D 17/20* (2006.01)

(52) U.S. Cl.
CPC ..... *B22D 17/203* (2013.01); *B22D 17/2038* (2013.01)

(58) Field of Classification Search
CPC B22D 17/203; B22D 17/2038; B29C 45/53; B29C 45/74
USPC ..... 164/113, 312
See application file for complete search history.

(56) References Cited

U.S. PATENT DOCUMENTS

| | | | | |
|---|---|---|---|---|
| 5,048,592 | A * | 9/1991 | Mueller | B22D 17/203 164/312 |
| 7,900,552 | B2 * | 3/2011 | Schivalocchi | B22D 17/203 92/186 |
| 8,136,574 | B2 * | 3/2012 | Muller | B22D 17/2038 164/312 |

FOREIGN PATENT DOCUMENTS

| | | | |
|---|---|---|---|
| DE | 10 2005 048717 | A1 | 4/2007 |
| DE | 20 2010 004934 | U1 | 8/2011 |
| WO | WO 03/074211 | A2 | 9/2003 |
| WO | WO 2007/116426 | A1 | 10/2007 |
| WO | WO 2009/146568 | A1 | 12/2009 |
| WO | WO 2010/084449 | A1 | 7/2010 |

OTHER PUBLICATIONS

International Search Report and Written Opinion dated Jul. 11, 2014 issued in corresponding International patent application No. PCT/CH2014/000043.

* cited by examiner

*Primary Examiner* — Kevin E Yoon
(74) *Attorney, Agent, or Firm* — Ostrolenk Faber LLP

(57) ABSTRACT

A die casting piston (1) for die casting nonferrous metals has at least one outer part such as a piston body (11), an intermediate ring (9), a sealing ring (7) etc. that is generally ring-shaped so as to surround a piston carrier (3) and provided with an axial slot (41, 59, 117) so that the part can expand and contract tangentially during a temperature change, e.g. from ambient temperature to operating temperature. Due to this design of the outer parts of the piston, cooling can be limited to a smaller portion of the piston, preferably substantially to the rear side of the piston cover (5; 154). The result is a substantially shortened overall construction of the die casting piston (1) that is reflected by reduced production costs. In accordance with the smaller dimensions of the cooled zone, a reduced coolant flow is required. In a preferred embodiment at least two parts, namely the piston body (11) and the piston cover (5; 154), are fastened to the piston carrier (3) by means of two bayonet locks (27, 33) of different diameters, thereby allowing an easy assembly from the front face without special tools.

16 Claims, 7 Drawing Sheets

FIG. 8
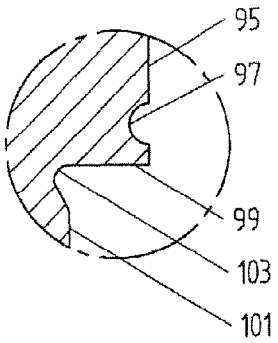
FIG. 5
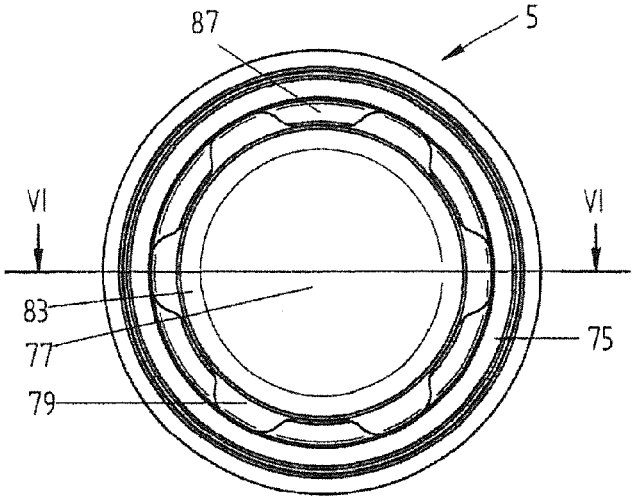
FIG. 9
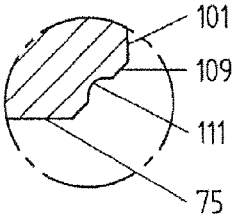
FIG. 6
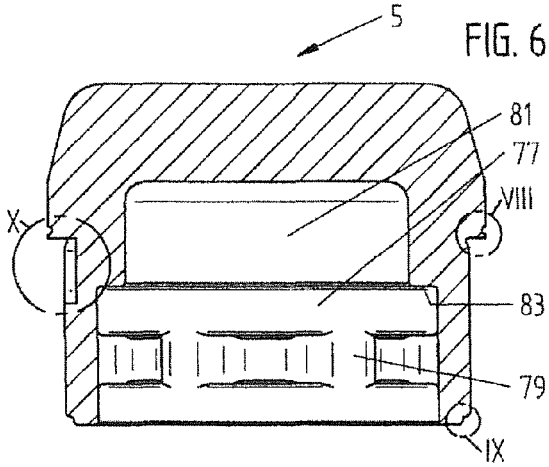
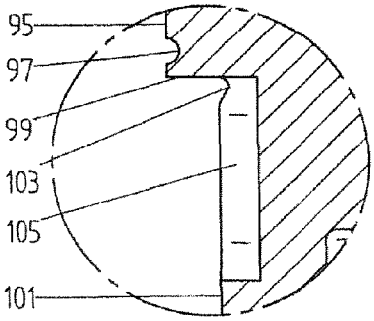
FIG. 10
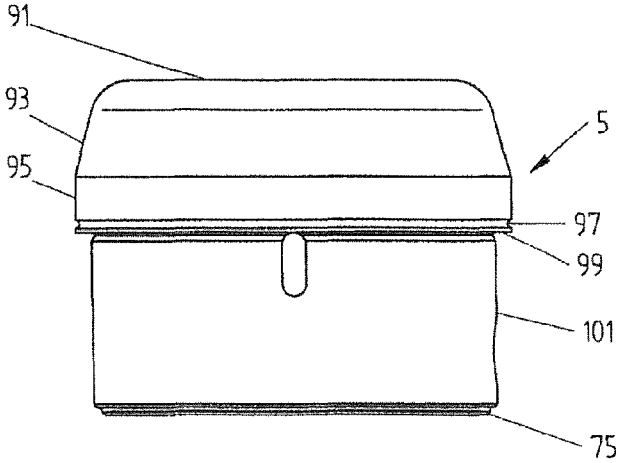
FIG. 7

FIG. 11
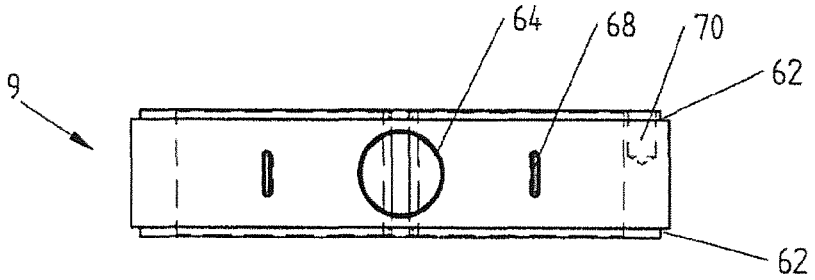
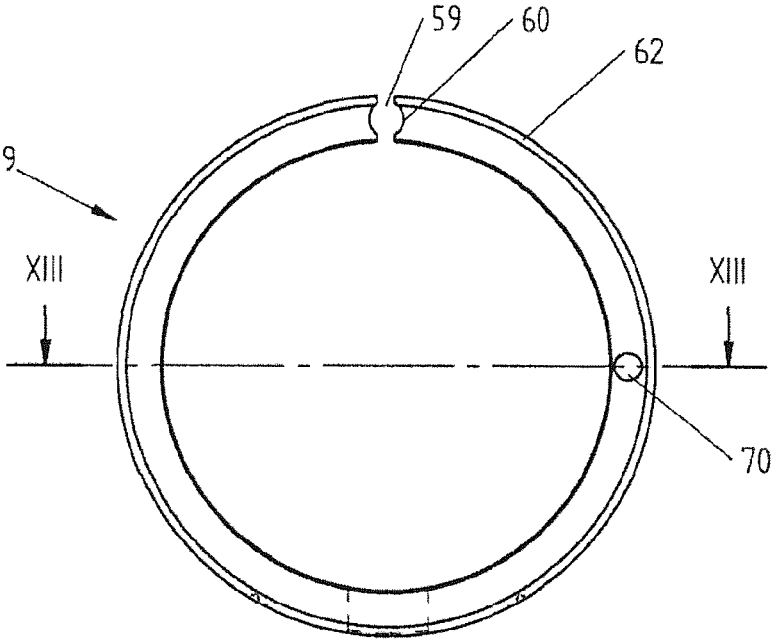
FIG. 12
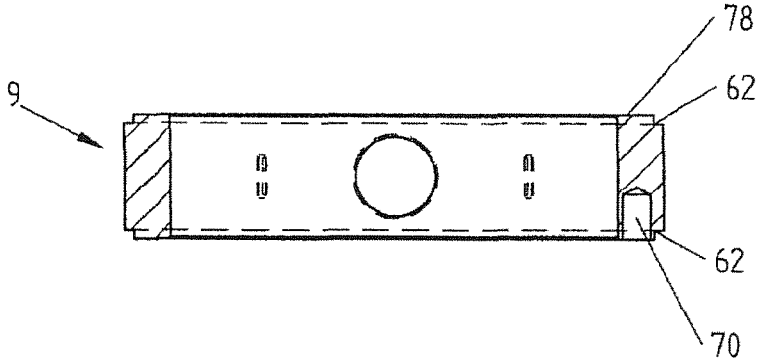
FIG. 13

FIG. 14
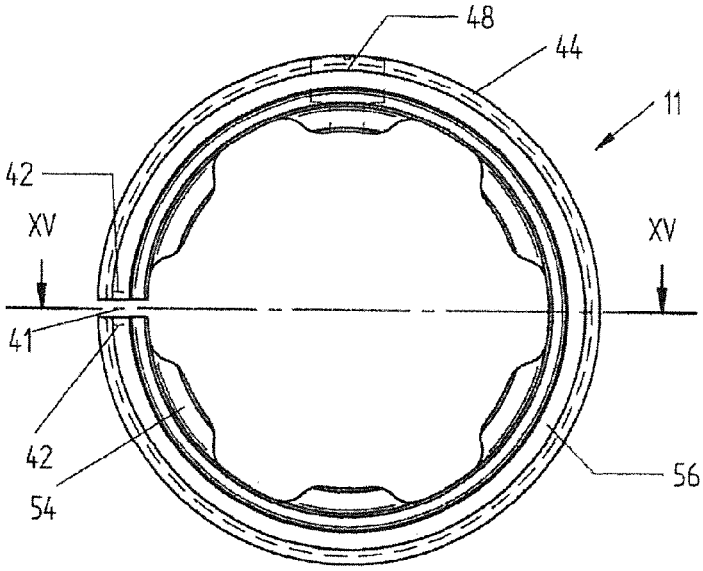
FIG. 17
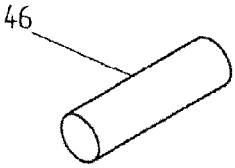
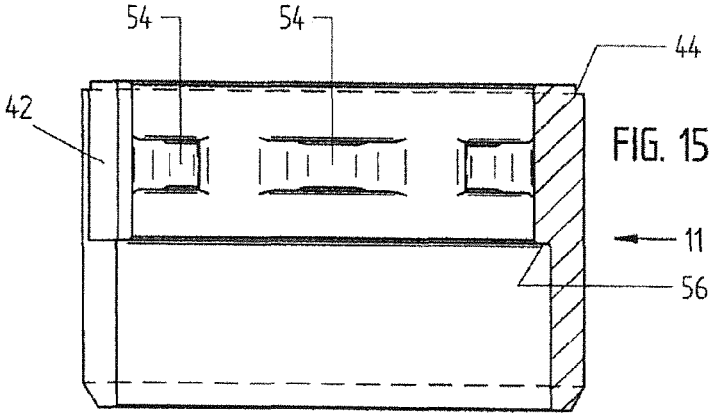
FIG. 15
FIG. 18
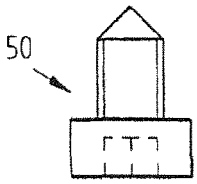
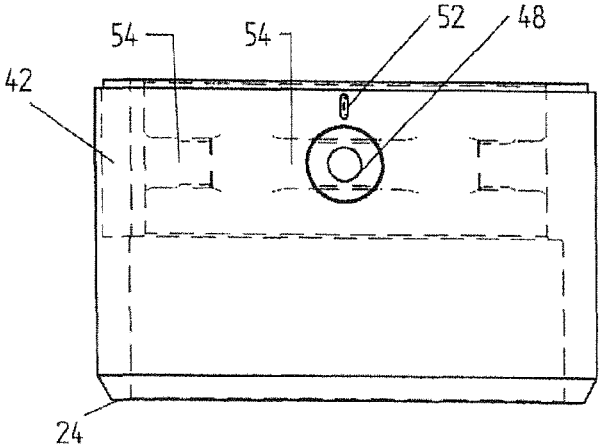
FIG. 16

FIG. 19
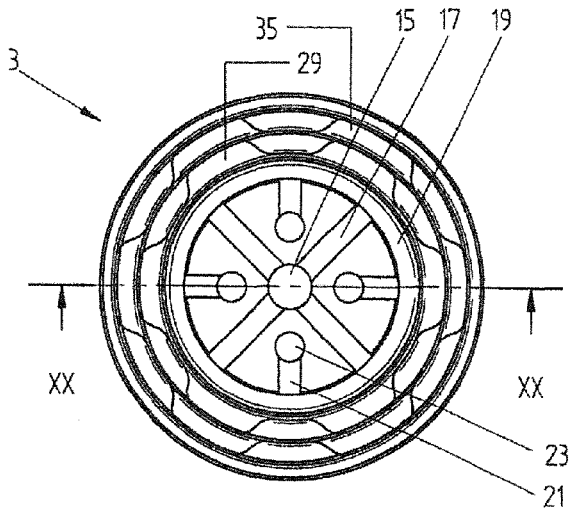
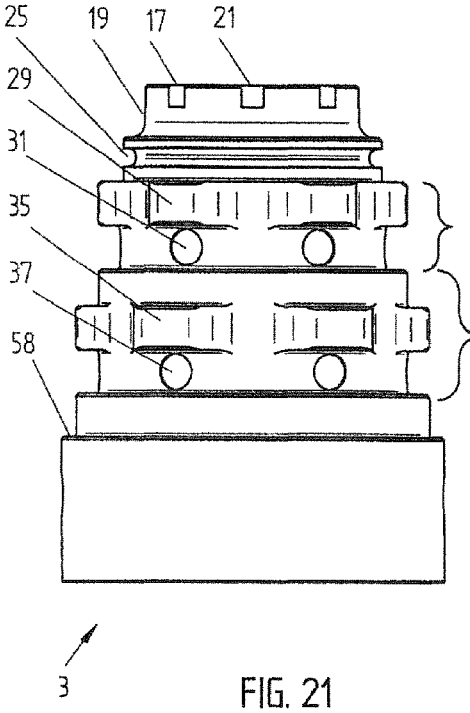
FIG. 21
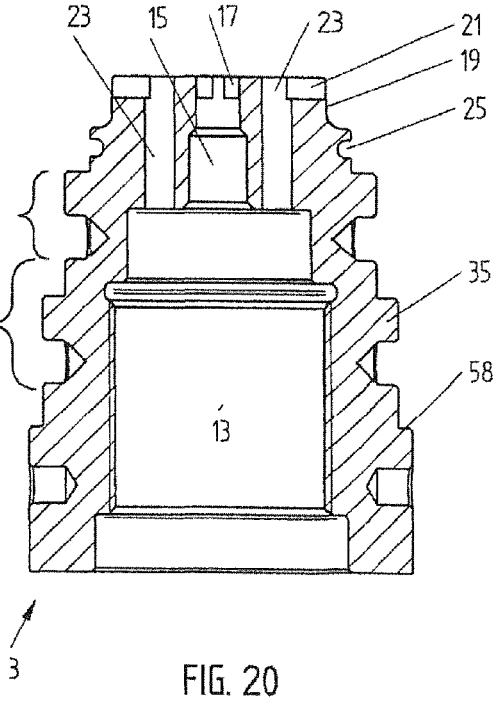
FIG. 20

PISTON FOR METAL DIE CASTING

CROSS REFERENCE TO RELATED APPLICATIONS

The present application is a 35 U.S.C. §371 National Phase conversion of PCT/CH2014/000043, filed Apr. 3, 2014, which claims benefit of Swiss patent application no. 00719/13, filed Apr. 4, 2013, the disclosure of which is incorporated herein by reference. The PCT International Application was published in the German language.

TECHNICAL FIELD OF THE INVENTION

The present invention relates to a piston for metal die casting according to the preamble of claim 1. The metal is preferably a nonferrous metal, more preferably aluminum.

BACKGROUND OF THE INVENTION

In metal die casting, the liquid metal is pressed into a mold by means of a piston. In the hot chamber technique, the melting and holding crucible is part of the machine, and pressures of 200 N/cm$^2$ (Newton per square centimeter) are used. In the cold-chamber technique, the liquid metal is filled into the machine and forced into the mold by means of a piston while pressures of 2,000 N/cm$^2$ to 25,000 N/cm$^2$ are usual. In accordance with the high arising pressures and the high temperatures of the molten metal, which enters into direct contact with the piston, a decisive question with regard to economy is how long the piston and in particular its front face will withstand the mechanical and thermal stresses. Essential factors in this regard are the lifetime of the sealing or piston rings that seal the piston against the surround cylinder wall. In addition it will be noted that any wear of the cylinder wall by the sealing rings should be avoided as far as possible as it is possible to replace the piston but any wear of the cylinder wall may entail an expensive overhaul or even the replacement of the casting tool.

One problem in the design of the sealing rings are the arising large temperature differences and variations. To accommodate the latter, the sealing rings require a moving space in the piston body. However, there is a risk that liquid metal may enter into these moving spaces through the gaps between the sealing rings and the piston body, thereby making it impossible for the sealing rings to contract on cooling. The result is an increasingly larger piston ring and an increased piston ring pressure on the cylinder wall, and thus increased wear. A common measure taken to reduce the need for such moving spaces is to cool the piston in the area where the sealing rings are arranged. However, the connection of the piston to the piston rod needs to be located behind the cooled section so that a great total piston length results. However, pistons of such a large size entail a high material usage and are expensive to manufacture. In this regard it should be noted that the size of the pistons corresponds to the size of the product. An example of the mass of a die casting product is one kilogram up to a ton. Larger units in the range of several tons or smaller parts are also possible, however.

Especially in large die casting machines, the relatively large cooled section of the piston requires a correspondingly high coolant flow that is often impossible to supply or not always available.

Such a piston is described in WO-A-03/074211. It is designed for a cold chamber die casting machine. The ingress of liquid metal into the expansion space of the sealing ring is prevented by making the circumference of the cover in front of this sealing ring large enough that a relatively narrow gap of a certain depth results. This gap, which is located in the cooled area of the piston, causes entering liquid metal to be strongly cooled and solidified in the gap already resulting in an additional sealing effect. However, this piston also suffers from the disadvantage that a considerable portion extending from the cover resp. the front face of the piston is being cooled so that all in all a great total length results and thus a high material usage for the piston.

SUMMARY OF THE INVENTION

It is an object of the present invention to provide a piston for metal die casting, more particularly of nonferrous metals and their alloys, that distinguishes itself by a substantially reduced length and thus a reduced material usage.

Another object of the present invention is to provide such a piston having a reduced risk of molten metal entering into hollow spaces that serve the purpose of allowing a movement of sealing rings relative to the piston body in order to accommodate thermal expansion.

A piston that achieves at least the first mentioned object is defined in claim 1. The following claims indicate preferred embodiments.

Thus, an essential feature of a piston according to the invention is the finding that it is sufficient to substantially cool the piston on its front face exclusively when enough expansion spaces are otherwise provided for accommodating thermal expansion, in particular of the sealing rings relative to the piston body. Preferably, a system of radial cooling channels arranged on the front face of the piston carrier is therefore suggested, a part of which leads the coolant from the center of the front surface, where the supply line ends, to the periphery where it is supplied to the other radial channels by a ring line. These radial channels lead the coolant back to the center where the inlet of the discharge line for the heated coolant is located. The proportion of the cooled part to the length of the piston carrier can thus be reduced to ¼ and preferably further to ⅕ or even to 15% or less. Particularly preferably, the cooling system may substantially be limited to a surface of the so-called piston carrier that carries the piston cover, which means that substantially only the rear side of the piston cover is being cooled.

According to a first variant, the sealing rings are slotted, in particular by providing a stepped slot. In this case, additional cavities are provided in the area of the slot in order to receive liquid material penetrating into this zone. These cavities have a capacity that is sufficient for the intended lifetime of the piston.

Such receiving cavities are preferably also provided in the area of a circumferential gap between the sealing ring and the piston body. In this manner, a detrimental effect of penetrating metal is prevented by deviating it into cavities that are intended for this purpose.

Due to the slotted design, the components are allowed to move tangentially to the piston surface when heated, i.e. along the circumference, while only a small change in diameter results or, respectively, a tendency to an increase in diameter caused by a temperature variation only produces a small outwardly acting force since a clearance is provided for yielding to this force.

In a further preferred embodiment, the piston is designed such that in the initial phase of the cast, the feed pressure and the back pressure will press the metal piston skirt, the sealing rings, and the front cap against one another and thus seal the gaps between these parts. This is preferably achieved in that a sleeve-shaped piston body rests on a step of the piston carrier. The piston body is followed by an intermediate ring and the latter by the peripheral zone of the piston cover. The latter is only supported by the piston carrier in an area that is distinctly offset towards the center. When pressed into the molten metal, the peripheral zone is thus minimally deformed in the sense of being pressed against the intermediate ring that is supported on the piston carrier via the piston body. This force is opposed by the thrust force that acts upon the piston body and thus also upon the opposite side of the intermediate ring via the step.

Arranging the sealing ring at least partly between the intermediate ring and the piston cap also leads to an increased lateral pressure on the flank of the sealing ring and thus to an improved seal.

In a further preferred embodiment of the invention, the piston carrier is provided with two consecutive bayonet locks of which the one at the rear serves for fastening the piston skirt and the one at the front for fastening the cap. Thereby a replacement of the cap and the piston body is simplified.

In an even further preferred embodiment, the bayonet locks comprise at least six studs so that a rotation by 30° for locking and unlocking is sufficient and a positioning in steps of 60° is possible.

BRIEF DESCRIPTION OF THE DRAWINGS

The invention will be explained in more detail by means of exemplary embodiments with reference to the Figures.

FIG. 5 Rear view of a piston cover (piston cap);

FIG. 6 Section according to VI-VI in FIG. 5;

FIG. 7 Lateral view of the piston cover of FIG. 5;

FIG. 8 Detail VIII in FIG. 6;

FIG. 9 Detail IX in FIG. 6;

FIG. 10 Detail X in FIG. 6;

FIG. 11 Lateral view of an intermediate ring;

FIG. 12 Front view of the intermediate ring;

FIG. 13 Section according to XIII-XIII in FIG. 12;

FIG. 14 Front view of a piston body;

FIG. 15 Section according to XV-XV in FIG. 14;

FIG. 16 Lateral view of the piston body;

FIG. 17 Positioning bolt;

FIG. 18 Locking screw;

FIG. 19 Front view of a piston carrier;

FIG. 20 Longitudinal section XX-XX in FIG. 19;

FIG. 21 Lateral view of the piston carrier;

DESCRIPTION OF EMBODIMENTS

Figure 22:
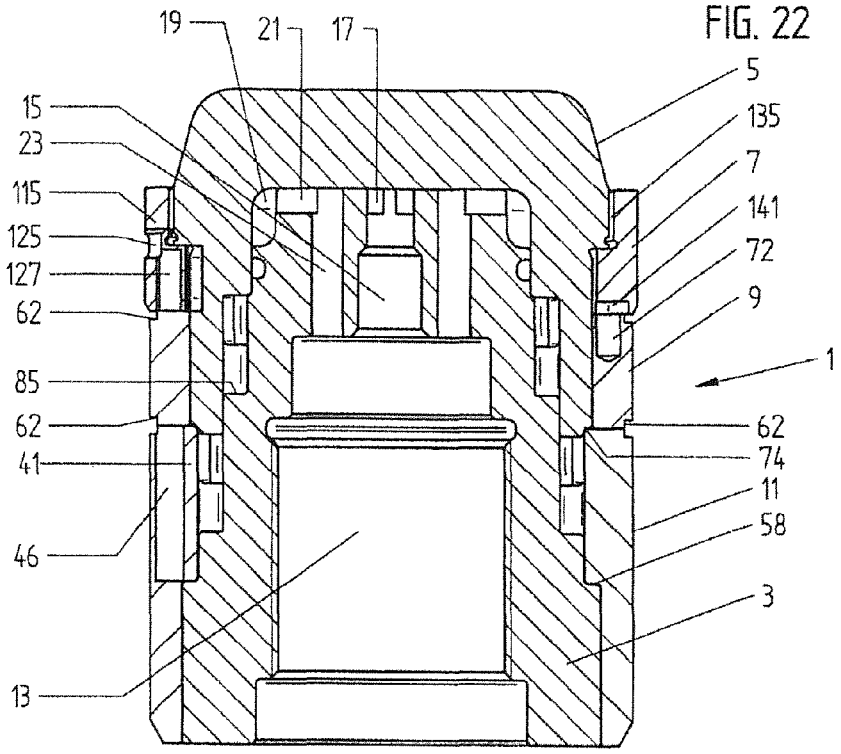
FIG. 22 Vertical longitudinal section in analogy to XX-XX in FIG. 19 through a complete piston.
Figure 23:
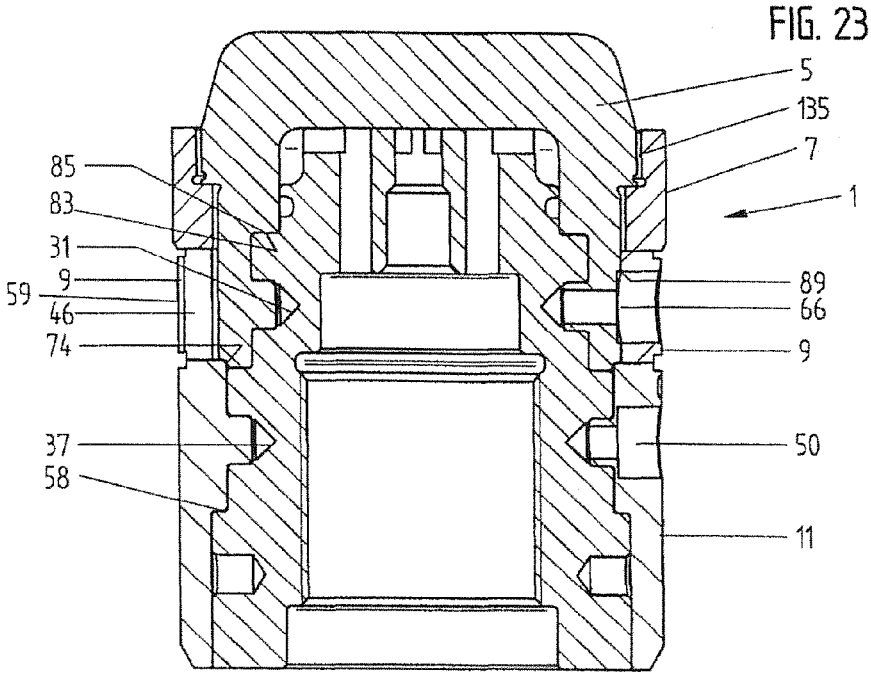
FIG. 23 Longitudinal section through the piston perpendicularly to the section of FIG. 22.

FIGS. 22 and 23 show a first embodiment of a die casting piston 1 according to the invention in vertically superposed longitudinal sections. Starting from the front face, the following parts are arranged on the cylinder carrier 3: cover 5, sealing ring 7, intermediate ring 9, and piston body 11.

Piston carrier 3, intermediate ring 9 and piston body 11 are made of steel. The preferred material for cover 5 is copper, but steel may be contemplated as well. Sealing ring 7 is also made of steel. In the interior of piston carrier 3, the piston rod fixture (not shown) is located which is designed in one of the usual ways that are known per se (see also WO-A-03/074211 and the therein cited prior art). Inside the piston rod extend the coolant supply and discharge lines. Usually it is the supply line, which is connected to the central connection 15 of the cooling system of piston carrier 3, that is arranged in the center. From central connection 15, first cooling channels 17 extend on the front surface of piston carrier 3 (FIG. 19). They are connected via a ring line 19 to the second radial cooling channels 21. Accordingly, the cooling system comprises the area from the first radial channels 17 to the second radial channels 21.

The second cooling channels 21 lead to axial return lines 23 arranged around central connection 15. Axial return lines 23 are to be connected to the second coolant line in the piston rod. As seen in FIGS. 19 to 21, which show the piston carrier, the first and second cooling channels 17, 21 are embedded in front face 3 of the piston carrier and are designed as open channels. In contrast to known embodiments of die casting pistons, it is thus primarily the rear side of piston cover 5 that is cooled.

As compared to conventional constructions where a portion of the order of a third of to half the length of the piston is cooled, the concentration of the cooled zone on the contact area between piston carrier 3 and piston cover 5 results in a substantially reduced demand of coolant. In conventional constructions, especially in large die casting installations, it is often problematic in practice to provide the required coolant flow under all operating conditions. This problem is substantially alleviated by the smaller thermally controlled zone that is virtually reduced to a plane. Insufficient coolant flow and thus overheating of parts of the piston are essential factors leading to premature wear of piston components whereby substantial additional costs may be entailed.

A further advantage of the substantially reduced axial extent of the cooling zone of the piston is that fixture 13 of the piston rod can be placed nearer to the front surface, thereby considerably reducing the total length of the piston carrier and thus of piston 1. This allows a reduced material usage in the manufacture of pistons 1 and thus a substantial reduction of the production costs. The latter is not only due to the reduced expenditure for the smaller quantity of raw material, taking into account that the parts are often machined from a solid block, but also to the fact that the workpiece is smaller per se and is thus less demanding with regard to the machine tool. As shown in the Figures, the present invention allows reducing the section of piston 3 required for cooling to 20% of the piston length, the latter being defined as the distance between the front surface 91 (see below) of cover 5 and the rear edge 24 of piston body 11.

Piston Carrier

Piston carrier 3 is illustrated in FIGS. 19 to 21. The front end of piston carrier 3 is provided with the already discussed cooling channels 15 to 21. Circumferential groove 25 serves for receiving an O-ring. Providing an O-ring at this location is a common measure, particularly for operating temperatures from 200° C. to 300° C.

A first bayonet lock 27 with studs 29 follows. Each stud 29 has an associated conical locking recess 31. First bayonet lock 27 serves for fastening cover 5 (see below).

First bayonet lock 27 is followed by a second bayonet lock 33 with studs 35 and locking recesses 37. This second bayonet lock 33 serves for fastening piston body 11 (see below).

A notable feature of both bayonet locks is that each of them has six regularly arranged studs 29 and 35, respectively. This measure allows aligning the parts to be fastened thereto in steps of 60° to attach them to the bayonet locks and to lock them. Furthermore, a rotation by half the offset of the studs, i.e. here by 30°, is accordingly sufficient to achieve the locked state. The result is a substantially simplified handling of the parts to be attached. Due to the design of the bayonet locks with different diameters it is possible to attach cover 5 and piston body 11 from the front face of piston 1, which is generally substantially simpler than pushing the piston body onto the carrier from the rear as according to the prior art.

Inside piston carrier 3, the aforementioned fixture 13 for the piston rod and the openings of axial return lines 23 and of central cooling connection 15 are arranged.

Piston Body

Piston body 11 is illustrated in FIGS. 14 to 16. It is substantially in the form of a sleeve that is cut at slot 41. Both walls of slot 41 are provided with respective grooves 42. Grooves 42 serve the purpose of taking up liquid aluminum that may reach this zone. Step 44 serves the same purpose. It should be noted that piston body 11 will generally be mounted such that slot 41 is located at the bottom in the operational casting tool. More specifically, for the purposes of the invention, "at the bottom" means in the direction of gravity. Grooves 42 and step 44 prevent that aluminum that has penetrated into this zone may hinder the thermal expansion or contraction, respectively, of piston body 11 by blocking slot 41 or entering between the cylinder wall and piston body 11.

In the substantially cylindrical space created by grooves 42, a bolt 46 (FIG. 17) of soft copper is arranged. It has such a size as to fill this space in piston body 11 in its initial state. On account of its softness, its deformation will allow slot 11 to narrow as a result of the thermal movement of piston body 11 without causing an excessive wear-increasing force.

A radial bore 48 provided with a thread is offset 90° from slot 41. During assembly, locking screw 50 (FIG. 18) is to be inserted therein in order to lock piston body 11 against rotation in the fastened condition by engaging in a locking recess 31 in piston carrier 3. Between bore 48 and the front face of piston body 11, a marking 52 is provided which together with the corresponding markings 68 (see below) serves for alignment purposes on opening and closing the bayonet lock.

At the front and in the interior of piston body 11, studs 54 are provided by which piston body 11 is fastened to second bayonet lock 33. A further particular feature is step 56 in the interior of piston carrier 11 which separates the smaller internal diameter of the front portion from the larger one of the rear portion. Step 56 of piston body 11 rests on the corresponding step 58 of piston carrier 3 (see FIGS. 20, 21). By this step 56, axial forces acting while piston body 11 is being thrust forward are transmitted to piston carrier 3.

Intermediate Ring

FIGS. 11-13 show intermediate ring 9. Intermediate ring 9 surrounds the rear part of cover 5 in the area of first bayonet lock 27. It has a slotted design as well (slot 59) so as to allow a thermal expansion movement. The walls of slot 59 are provided with grooves 60 of partly circular cross-section. Again, during assembly, a pin of (soft) copper is inserted that substantially corresponds to pin 46 (FIG. 17). Its function corresponds to that of pin 46. Peripherally on its front surface, intermediate ring 9 is provided with steps 62 that serve for receiving aluminum residues similarly to step 44.

Figure 1:
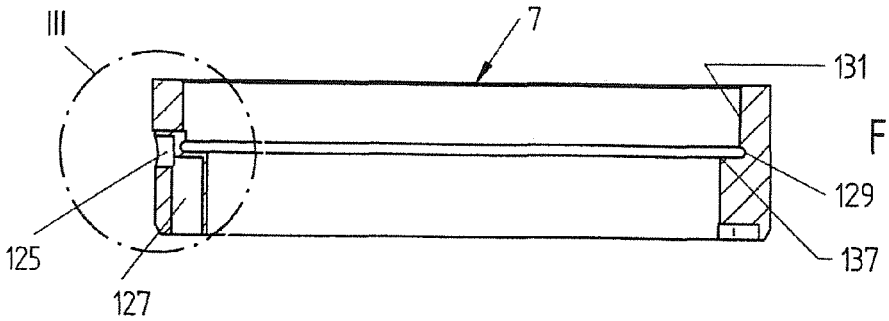
FIG. 1 Section through a sealing ring according to I-I in FIG. 2.
Figure 2:
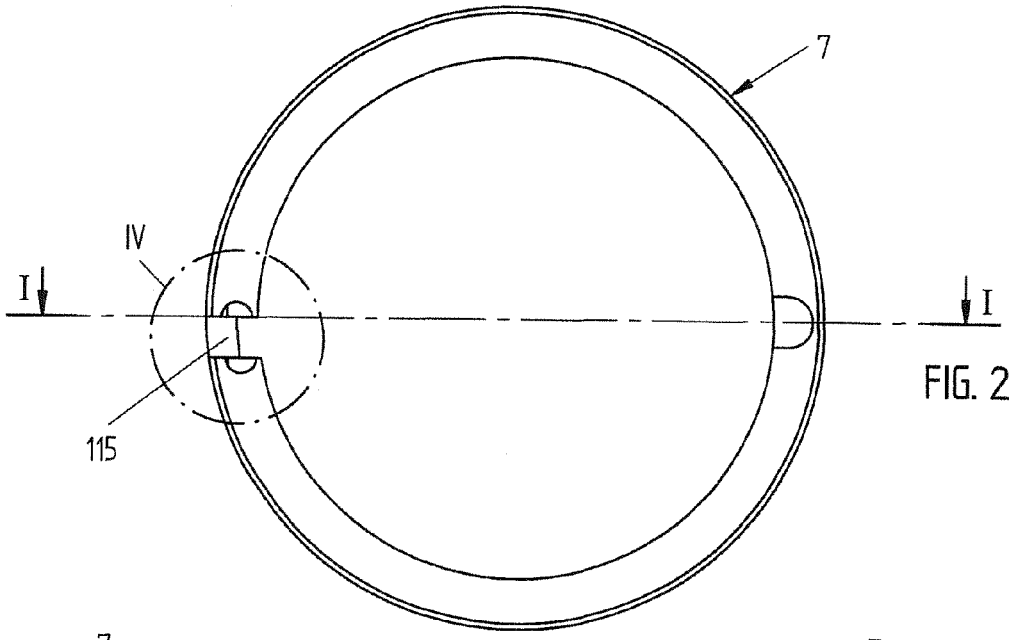
FIG. 2 Rear view of a sealing ring according to FIG. 1.

Opposite slot 59, a bore 64 for locking screw 66 (see FIG. 23) of cover 5 is arranged. On both sides of bore 64, markings 68 are provided which together with marking 52 indicate the released position of the bayonet lock. Blind bore 70 is intended to receive a positioning pin 72 by which sealing ring 7 is locked against rotation (see FIG. 2). As seen in FIGS. 22, 23 also, piston body 11 has an inner tapered portion 74 on its front face so that front surface 76 coincides with rear surface 78 of intermediate ring 9 but may contact the rear end 75 of cover 5 via inclined plane 74, as the case may be. Axial forces are thus directly transmitted from intermediate ring 9 to piston body 11 but only to a limited extent from piston cover 5 to piston body 11 via this inclined plane.

Cover

Cover 5 is illustrated in FIGS. 5 to 10. It is preferably made of copper, and in contrast to the previously described outer parts of piston 1, it is free of arrangements facilitating thermal expansion such as a slot, in particular. In the interior of cover 5 there is a hollow space 77 in the rear part of which bayonet lock 79 is located that is complementary to first bayonet lock 27. The forward portion 81 of hollow space 77 on the front face is to receive the front end of piston carrier 3 with the cooling devices (cooling channels 17, 19, 21). Between bayonet lock 79 and the front section 81 of hollow space 77 a step 83 is provided. This step of cover 5 rests on a corresponding step 85 of piston carrier 3. Together with the wall sections between the cooling channels 17, 21 formed on the front face of piston carrier 3, it forms the primary support of cover 5 by which the forces arising during the forward thrust of piston 1 are transmitted to piston carrier 3. As in piston body 11 (see FIG. 16), one of studs 87 of bayonet lock 79 is provided with a bore 89 (see FIG. 23) having a thread. A locking screw 50 is screwed into this bore in order to lock the cover against rotation and against disengagement from the bayonet lock by engaging in one of locking recesses 31.

The outer surface of cover 5 includes a front face section that enters into contact with the liquid metal during the casting operation. It is essentially composed of front surface 91 and of a following slanted flank 93 that is in turn followed by a cylindrical surface 95. At the rear end of cylindrical surface 95 a circumferential groove 97 is arranged (see FIG. 10). The latter is followed at the rear by a step 99 and a following second cylindrical surface 101 of smaller diameter. At the junction between step 99 and cylinder surface 101 a rounded circumferential groove 103 is arranged. In at least one location, an axially extending elongated recess 105 ends in this groove. In the mounted condition of die casting piston 1, cover 5 is fitted in such a position that recess 105 is located at the lowest possible point, i.e. as low as possible. The rearward outer edge 109 is tapered and provided with a circumferential groove 111. The mentioned recesses, cavities, and grooves serve for receiving, either temporarily or permanently, as the case may be, liquid metal that has penetrated thus far in order to prevent malfunctions of the die casting piston or, respectively, increased wear in particular of the sealing ring but also of the cylinder (see the explanations on sealing ring 7 below).

Sealing Ring

Sealing ring 7 is illustrated in FIGS. 1 to 7. It is preferably made of steel, i.e. substantially of the same material as intermediate ring 9 and piston skirt 11. According to another aspect, it is made of a harder material than cover 5.

Figure 3:
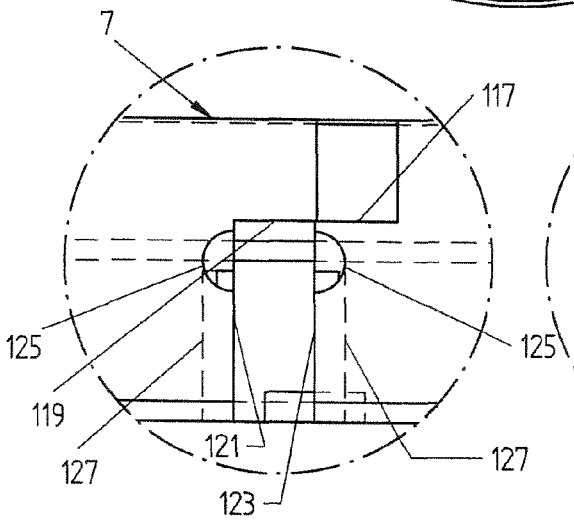
FIG. 3 Detail III in FIG. 1.
Figure 4:
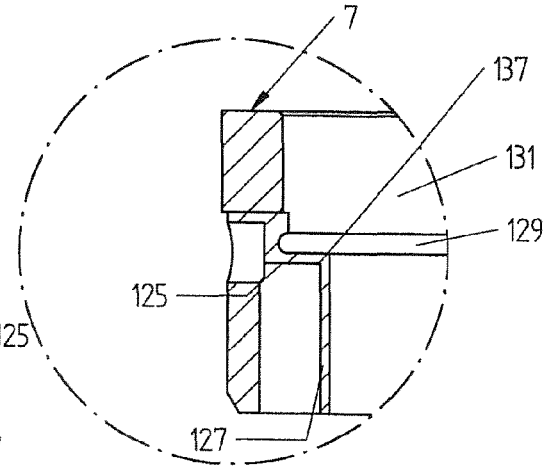
FIG. 4 Detail IV in FIG. 2.

It has the general shape of a ring and is slotted like intermediate ring 9 and piston body 11, slot 115 being designed as a stepped slot in order to prevent liquid metal from passing therethrough (see FIG. 3). In particular, the representation in FIG. 3, where only a minimal overlap of steps 117, 119 on the two slot sides remains, corresponds to a condition at the end of the life cycle of sealing ring 7. In a new, unused sealing ring, this slot is almost closed. An enlargement of slot 115 of 3/10 mm up to 1 mm is generally considered as the wear limit. In the current state of the art, 3 millimeters can be considered as an upper limit. This corresponds to a variation in diameter of 0.1 to 0.3 mm and of at most 1 millimeter of the sealing ring.

The wall sections 121, 123 of slot 115 located rearwardly of steps 117, 119 are provided with mutually facing radial grooves 125 of substantially semicircular cross-section. These are in fluidic communication with grooves 127 that extend axially rearwardly and further inwardly in walls 121, 123. Grooves 125 take up metal (aluminum) that may have passed through slot 115 and may penetrate further into axial grooves 127 without impairing the function of sealing ring 7 or affecting its moving space for thermal expansion.

On the inner side, approximately in the prolongation of radial grooves 125, a circumferential groove 129 is arranged. The inner surface 131 of the section of sealing ring 7 located in front thereof is shaped so as to lie closely against cylinder surface 101 of cover 5. As seen in FIGS. 22, 23, aluminum may enter into the gap 135 between piston cover 5 and sealing ring 7, grooves 97 and 129 forming an additional volume for receiving the molten metal. Step 137 that follows groove 129 comes to lie on step 99 (see FIG. 8) of cover 5 and thus seals gap 135 so that liquid metal cannot penetrate further. The sealing effect is improved due to the fact that with increasing pressure, owing to the greater resilience of the material of cover 5, the latter will slightly yield to the pressure circumferentially whereas the steel parts of piston 1 are more resistant. Therefore, a higher pressure on the piston will result in a higher contact pressure of step 99 on step 137 and in an accordingly improved sealing effect. This effect may be further enhanced by designing the cover so as not to contact the front surface of piston carrier 3 in the unloaded condition. It is also important in this context that piston body 11 is substantially supported against a force applied by the front face of piston 1 on step 58 (FIG. 20) of piston carrier 3.

Opposite expansion slot 115 and on the rear side of sealing ring 7, a positioning recess 141 is provided. Positioning recess 141 receives the head of positioning pin 72 whereas its shaft is received in blind bore 70 provided in intermediate ring 9 (see FIG. 22). Sealing ring 7 is thus fixed in a given rotational position relative to the piston. The best effect of sealing ring 7 is obtained when expansion slot 115 is located at the bottom, i.e. at the lowest point in the cylinder.

Assembly/Maintenance

The assembly of the described die casting piston 1 is distinguished by the fact that piston body 3 and cover 5 are pushed onto piston carrier 3 from the front end. This is substantially made possible by the two bayonet locks 27, 33 of which bayonet lock 27 on the front face has a smaller diameter than rearward bayonet lock 33. Sealing ring 7 and intermediate ring 9 are pushed onto cover 5 before the latter is fastened to piston carrier 3.

Further it will be noted that the use of bayonet locks allows an assembly without special tools.

The possibility of withdrawing in particular the cover from piston carrier 3 towards the front face allows an easy disassembly of cover 5 for maintenance purposes. To this end, die casting piston 1 is advanced into the die casting mold chamber until locking screw 50 is accessible. As soon as the latter is unscrewed, cover 5 together with sealing ring 7 and intermediate ring 9 can be removed from piston carrier 3 by releasing bayonet lock 27. After overhauling, cover 5 with sealing ring 7 and intermediate ring 9 is again fastened to the piston carrier and the latter is pulled back into its cylinder. By tapered rearward edges and a conically shaped exit end of the cylinder, the sealing ring is automatically adjusted to the cylinder opening when pulled back.

Second Embodiment

Figure 24:
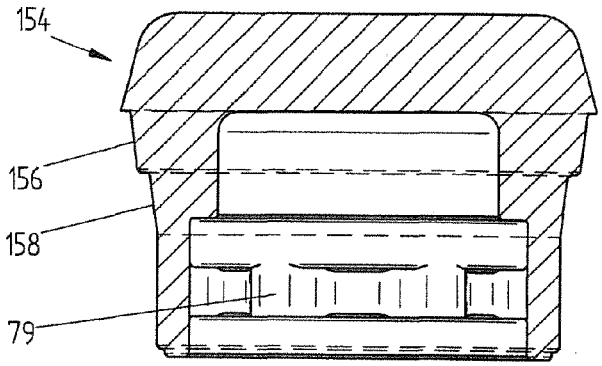
FIG. 24 Longitudinal section through a piston cap according to a second embodiment of the piston.
Figure 25:
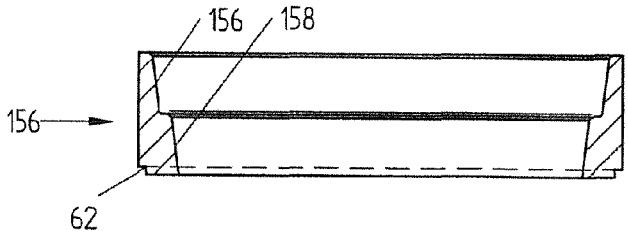
FIG. 25 Section in analogy to I-I in FIG. 2 through a sealing ring for the second embodiment.
Figure 26:
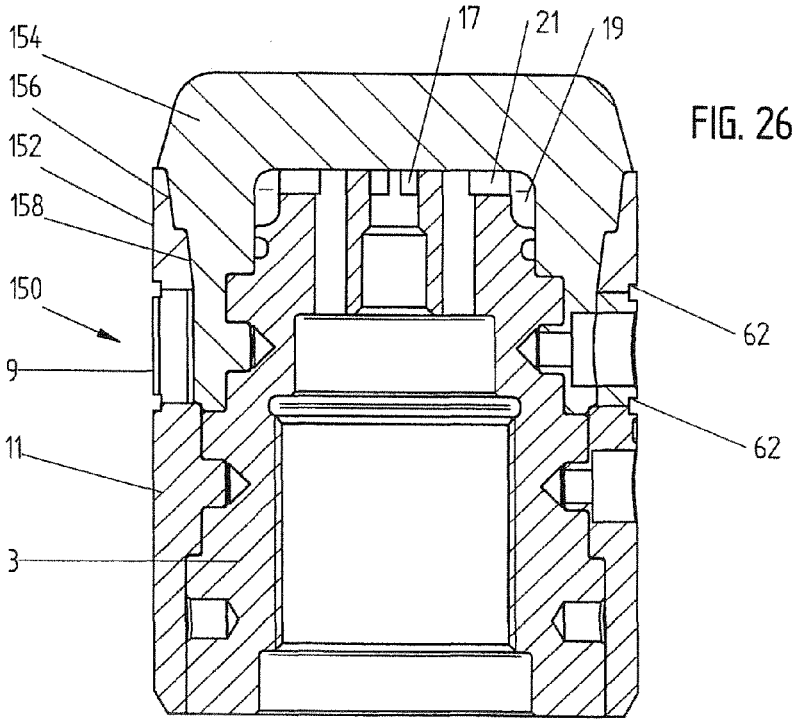
FIG. 26 Section in analogy to FIG. 22 through the second embodiment of the piston.

FIGS. 24 to 26 show a second embodiment of the die casting piston 150 according to the invention. Piston carrier 3, piston body 11, and intermediate ring 9, as well as generally all parts of die casting piston 150 that are not mentioned in particular, correspond to the first embodiment. In the second embodiment, sealing ring 152 is made of the same material as piston cover 154. Since the thermal expansion of these two parts is consequently the same, sealing ring 152 may be closed, i.e. it has no expansion slot. A preferred material for piston cover 154 and sealing ring 152 is copper.

In order to facilitate the removal of sealing ring 152 from piston cover 154, contact surfaces 156, 158 are inclined. Consequently, they represent conical surfaces where the respective cones taper toward the rear end of cover 154.

This embodiment distinguishes itself by the fact that e.g. slot 135 (FIG. 22, 23) and the gap in sealing ring 7 are substantially closed and there is thus a reduced risk that molten metal may penetrate to the rearward section of piston 150 past sealing ring 152. Metal residues that may nevertheless have penetrated will be taken up by the same reservoirs as described in the first embodiment.

From the foregoing description, numerous modifications and complements are accessible to one skilled in the art without departing from the scope of protection of the invention that is defined by the claims. In particular, the following variants may be contemplated:

- Other materials are used for certain parts of the die casting piston. Preferably, however, the material of the piston cover is more yielding to pressure than the remaining parts of the piston, in particular the piston body, so that the cover will be pressed against the piston body under the pressure of the molten metal and thus a better sealing effect against penetrating liquid metal is achieved with increasing pressure on the piston.
- The arrangement of the axial channels for the supply and return of the coolant may be chosen differently, and in particular they may be interchanged.
- The sealing ring consists of a different material, in particular of a steel that conserves its elasticity under the existing operating conditions (high pressures and temperatures), e.g. Dievar®, a heat-resistant steel.
- In a development of the second embodiment, the cover, the sealing ring, and the intermediate ring are designed as a single part, preferably of copper.
- In the second embodiment, the sealing ring consists of a different material from the cover. The differences in thermal expansion are taken into account by correspondingly adapting the tolerances.

What is claimed is:

1. Piston for metal die casting, comprising a piston carrier with a cover element attached to a front face thereof, piston body parts surrounding the piston carrier circumferentially on an axial length thereof, and at least one sealing ring, wherein at least one of the body parts is provided with a slot in the axial direction so that on thermal expansion of that body part during the passage from its idle temperature to its operating temperature a tangential movement with a change in slot width is enabled wherein a cooling device is provided and the cooling device extends over at most ⅕ of the distance between the front surface of the cover element and the rear edge of the piston body.

2. Piston according to claim 1, wherein at least one sealing ring is provided with a slot so that a tangential movement of the sealing ring for accommodating thermal expansion is enabled.

3. Piston according to claim 1, wherein a sealing ring 16 is arranged on the periphery of the cover element circumferentially and consists of the same material as the cover element, and in that the piston carrier comprises a cooling device in the section that is surrounded by the sealing ring, and that the cover element and the sealing ring are made of a material having a high thermal conductivity of at least 200 W/(K m), so that differences in thermal expansion of the cover element and the sealing ring are avoided and the operating temperature of the cover element and the sealing ring is reduced in order to reduce thermal expansion.

4. Piston according to claim 1, wherein a cooling device is provided and the cooling device extends over at most ⅕ of the distance between the front surface of the cover element and the rear edge of the piston body.

5. Piston according to claim 4, wherein the cooling device extends over at most 1/10 of the distance between the front surface of the cover element and the rear edge of the piston body.

6. Piston according to claim 1, wherein the cooling device extends from the front face over at most ⅕ of the length of the piston carrier.

7. Piston according to claim 6, wherein the cooling device extends from the front face over at most 15% of the length of the piston carrier.

8. Piston according to claim 1, wherein the cooling device includes cooling channels that are arranged in the cover element, between the cover element and a part of the piston carrier following the cover element, or in the part of the piston carrier following the cover element, so as to cool at least the cover element.

9. Piston according to claim 1, wherein the cooling device includes radially extending cooling channels that are all substantially arranged in a single plane.

10. Piston according to claim 1, wherein at least one piston body part and the cover element are each provided with at least one bayonet fastening device and respective corresponding bayonet fastening devices are arranged on the piston carrier, the bayonet fastening device that is arranged farther from the front face of the piston carrier having an at least as much greater diameter than the one that is arranged nearer to the front face so that the at least one piston body part and the cover element can be pushed onto the piston carrier one after another from the front face and locked by a rotational movement.

11. Piston according to claim 10, wherein at least one of the bayonet fastening devices comprise at least 6 locking studs so that an adjustment in the rotational direction in steps of at most 60° is enabled.

12. Piston according to claim 1, wherein the outer surface of the sealing ring is designed to contact a wall of a cylinder that is adapted to receive the piston, at least one contact surface selected from the outer surface and the inner, piston side contact surface of the sealing ring having at least one reservoir in the form of a circumferential or radial recess so that casting material penetrating the contact surface is capable of being received by the reservoir.

13. Piston according to claim 1, wherein the inner surface of the sealing ring, as seen from the front surface, has an inwardly projecting step and the cover element has a complementary step so that the cover element can be arranged so as to rest on the step of the steel ring, in that the piston carrier has, farther from the front surface, an outwardly projecting step and the piston body has a complementary step so that the pressure applied by casting material to the cover element during die casting may produce a sealing pressure acting on the gap between the cover element element of the sealing ring and the counterpressure of the sealing ring is provided by its abutment to the step of the piston.

14. Piston according to claim 1, wherein the piston is configured for die casting nonferrous metals.

15. Piston according to claim 14, wherein the nonferrous metal is magnesium.

16. Piston according to claim 14, wherein the nonferrous metal is aluminum.

* * * * *